US005524820A

United States Patent [19]

Regan

[11] Patent Number: 5,524,820

[45] Date of Patent: Jun. 11, 1996

[54] PORTABLE WATER HEATER UNIT FOR FIELD USE

[76] Inventor: Daniel V. Regan, 7883 Chestershire Dr., Cincinnati, Ohio 45241

[21] Appl. No.: 288,838

[22] Filed: Aug. 11, 1994

[51] Int. Cl.[6] ..... F24H 1/22

[52] U.S. Cl. ..... 237/19; 126/350 R; 126/350 D; 237/63; 392/451

[58] Field of Search ..... 237/19, 56, 57, 237/59, 63; 392/444, 449–456, 465; 126/350 R, 350 D, 344, 373; 137/340

[56] References Cited

U.S. PATENT DOCUMENTS

| | | | |
|---|---|---|---|
| 2,058,769 | 10/1936 | Brown | 392/453 X |
| 3,763,848 | 10/1973 | Williams | 237/19 X |
| 3,763,849 | 10/1973 | Pfluger et al. | 237/19 X |
| 4,200,783 | 4/1980 | Ehert | 392/456 X |
| 4,671,459 | 6/1987 | Stapensea | 237/19 X |

*Primary Examiner*—William E. Tapolcai
*Attorney, Agent, or Firm*—Charles R. Wilson

[57] ABSTRACT

A portable water heater unit is used to warm a source of ambient temperature water for field use. Warm or hot water is provided for food warming, making hot beverages, showering, and article washing purposes. The unit comprises a housing, a water heater mounted within the housing, a hot water holding tank mounted within the housing, an optional heat exchanger positioned in the hot water holding tank and a temperature control mixing valve operably associated with ambient and hot water lines. An ambient water inlet line leads from an external source of ambient temperature water to the water heater. A hot water line leads from the water heater to the holding tank. Water within the holding tank is directed to an external use source or is continuously recirculated back through the water heater and to the holding tank. An inlet line and an outlet line connected to the heat exchanger within the holding tank is used to supply hot water to make coffee, tea, soup or similar hot drink/food products. Hot water from the holding tank leads to the temperature control mixing valve where ambient temperature water can be mixed in. The water further is directed to one or more outlet connections whereby a hot or warm water use article such as a food warmer or shower is connected.

20 Claims, 4 Drawing Sheets

PORTABLE WATER HEATER UNIT FOR FIELD USE

This invention relates to a portable water heater unit. More particularly, the invention relates to a portable water heater unit for use in the field to supply warm or hot water.

Military personnel involved in a conflict often must spend an extended number of days in the field. Basic necessities such as food and shelter normally can be supplied. A water supply can be more problematic. Most people in civilian life waste a tremendous amount of water because of its plentifulness and low costs. There simply is no need to conserve. Such is not the case for a military unit which must carry its own water or possibly purify a natural water supply. Proper rationing of water for drinking and cleaning purposes will significantly extend a water supply. However, any rationing creates a hardship and is to be avoided if possible.

The occasional camper on a prolonged outing also has a need for water. Here also, only a limited amount of water can be transported by back or otherwise.

Hot or warm water for use by military personnel or the outdoorsman is an even greater problem. Most portable heater units available are very ineffective in operation and are capable of providing a very limited amount of warmed water. The warmed water is needed for, inter alia, making hot beverages such as coffee or soups, warming food, showering and cleaning equipment. The need for warmed water in the field is great as well recognized by anyone who has had to endure such an experience. The need has existed for many years, yet there is still no fully satisfactory system to meet the need.

In accord with a long recognized need, there has been developed a portable water heater unit especially designed for use in the field to satisfy many warmed or hot water needs. The water heater unit is compact and easily transported. It is readily used with currently available water, fuel and end-use equipment. It is versatile in that it can be used to supply warm water or hot water as the need dictates. Importantly, the water heater unit is efficient in operation.

SUMMARY OF THE INVENTION

A portable water heater unit for use in the field is provided to warm a source of externally supplied ambient temperature water. The unit is capable of supplying temperature controlled water through separate outlets for multi-use purposes. The portable water heater unit has a housing. Within the housing are mounted a water heater, a hot water holding tank, an optional heat exchanger, and a temperature control mixing valve. The water heater is connected to an ambient water inlet line leading from the external source of ambient temperature water with a recirculating water pump in operable association therewith. A primary hot water line leads from the water heater to the hot water holding tank. The holding tank is capable of providing a steady supply of hot water for continuous use upon demand. It has connected to it the primary hot water line leading from the water heater, a secondary hot water line leading therefrom and a recirculating water outlet line leading back to the ambient water inlet line. The optional, though preferred, heat exchanger is positioned within the hot water holding tank and is capable of providing a supply of hot water for intermittent use upon demand. It has a water inlet line and a water outlet line with a heat exchanger water pump in operable association therewith. Water which is fed to the heat exchanger by the water inlet line is warmed by the water in the holding tank and is then conveyed through the hot water outlet line for use by a hot water use article. The temperature control mixing valve is capable of mixing different sources of water fed to it to provide warm or hot water. Connected to the mixing valve are an ambient water inlet line from an external source, the secondary hot water line leading from the hot water holding tank, and an alterable water outlet line with an outflow water pump operably associated therewith.

DETAILED DESCRIPTION OF THE INVENTION

The portable water heater unit of the invention is of benefit to many classes of people, including military personnel, campers, disaster victims and rescue workers. However, it finds its most demand by military personnel and for this reason is described in detail below with this end-use in mind.

Figure 1:
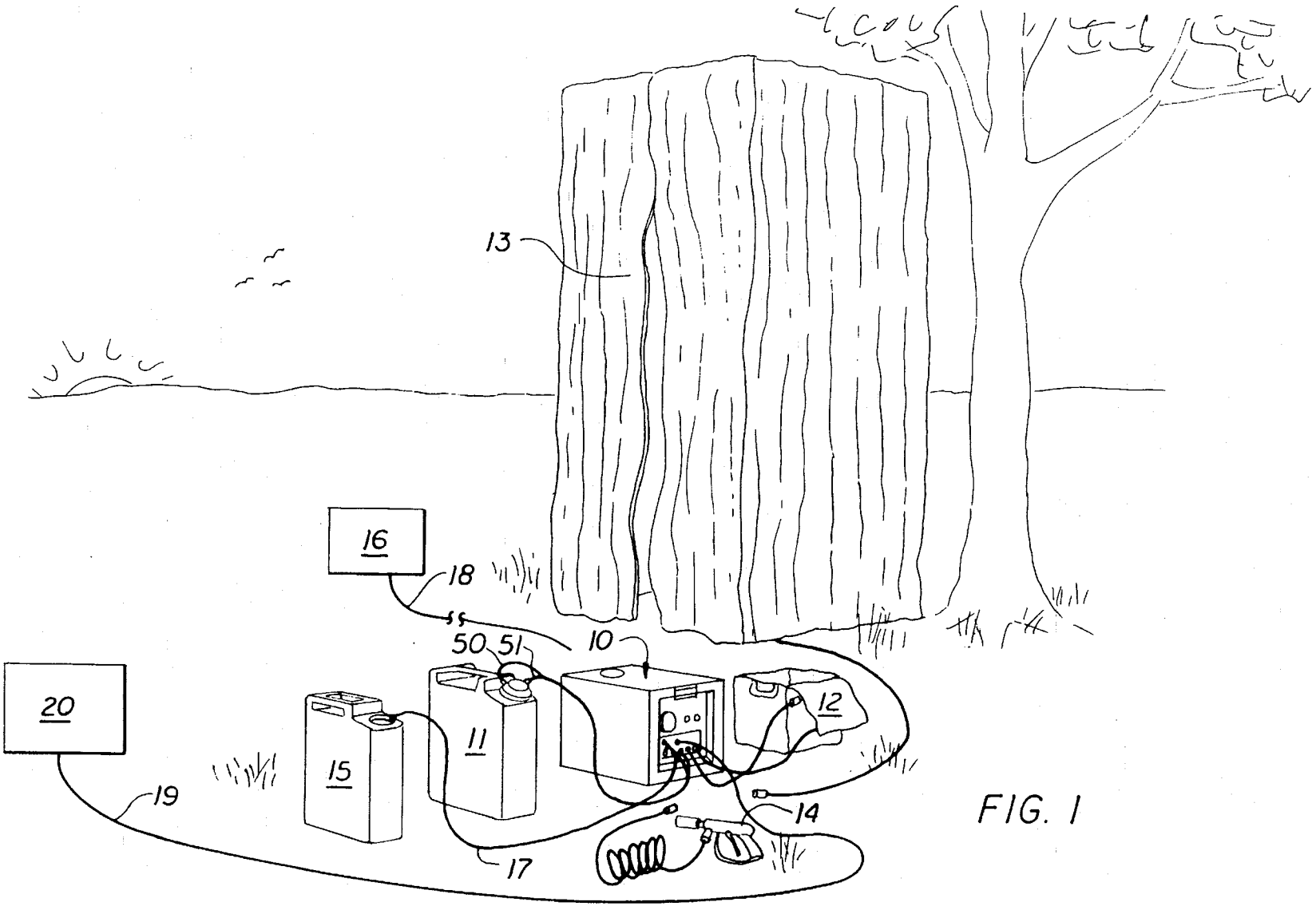
FIG. 1 is an environmental view showing the portable water heater unit of the invention in the field.

With reference to FIG. 1, there is shown an environmental view wherein the portable water heater unit 10 of the invention is in place and ready to meet several different warm or hot water demands. The water heater unit 10 as shown is operably connected by water hoses to a jerry can 11 to supply hot water for beverage or soup making purposes and a food warmer 12 to supply hot water for food ration warming purposes. It can readily be connected to a shower enclosure system 13 to supply warm water for bathing purposes and a spray wand 14 to provide warm or hot water to clean various military articles. The aforementioned water use articles are supplied individually or collectively by associated water lines up to the capacity of the portable water heater unit. The water use articles are especially designed to perform their functions with a limited supply of warm or hot water. The water heater unit of the invention provides an adequate supply of the warm or hot water to the water use articles so that the limited supply of ambient water is conserved and used efficiently as is often required in the field.

Figure 2:
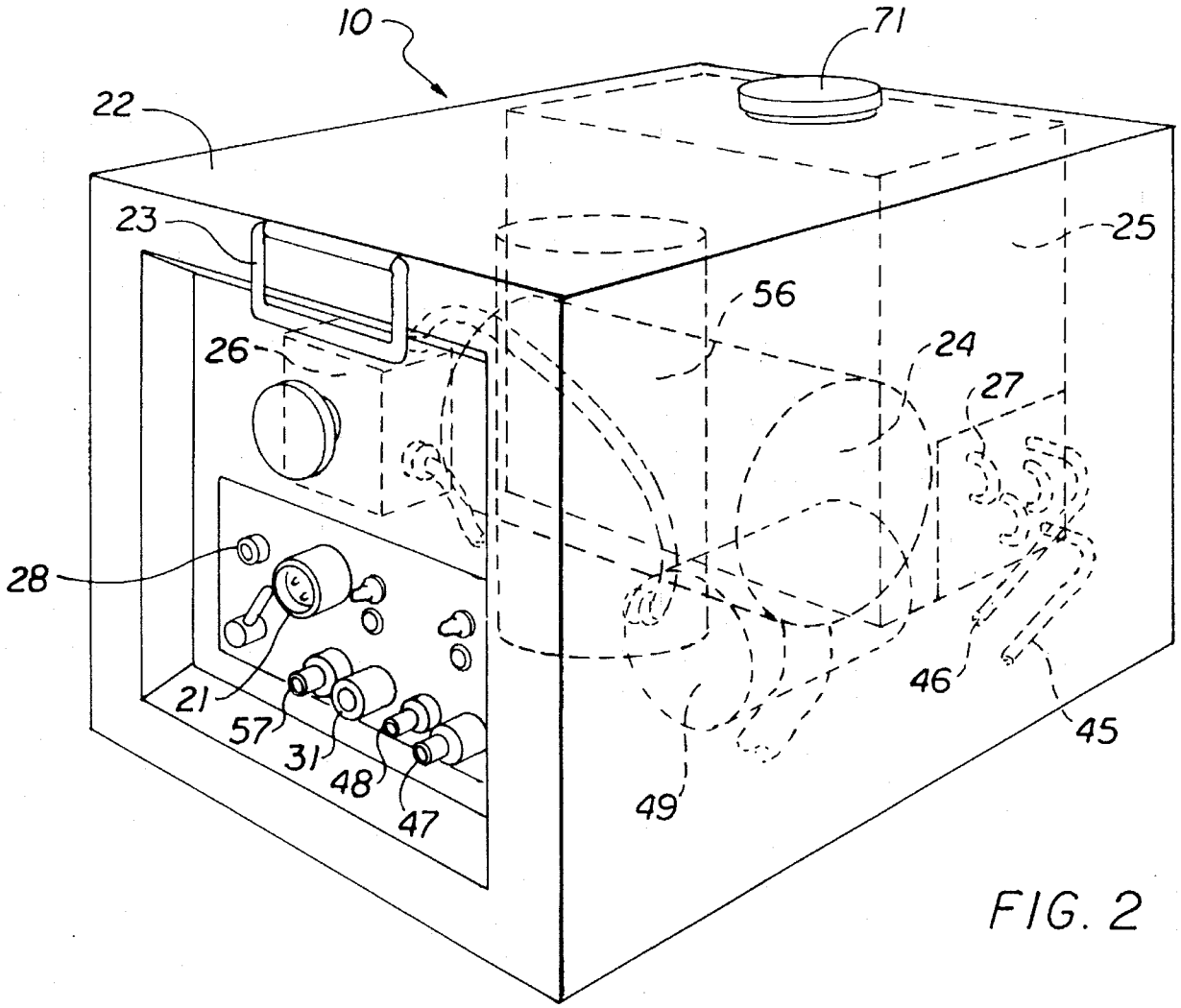
FIG. 2 is a perspective view of the portable water heater unit of the invention.

A fuel source 15 and a water source 16 are also shown attached by a fuel source line 17 and an ambient water source line 18, respectively to the water heater unit 10. The water source 16 includes a water tank truck, lake or stream. An electric power line 19 leads from an external power source 20 such as an electrical generator or battery and is plugged into a receptacle on the heater unit 10 to supply its power needs to run various pumps and controls. With reference to FIG. 2, the receptacle 21 is adapted for a high capacity power line. The generator or battery is itself portable or is mounted on a transport vehicle.

As evident in FIGS. 1 and 2, the portable water heater unit 10 is compact and capable of being transported with minimal effort. It has a housing 22 with handles 23 on opposed sides for lifting and carrying. Specially designed components for the purposes intended are mounted within it or on it. The essential components in accord with this invention include a water heater 24, a hot water holding tank 25, and a temperature control mixing valve 26. A highly preferred, though optional heat exchanger 27 is mounted within the holding tank 25. A detailed discussion of these individual components and the associated water inlet lines, water outlet lines, pumps and controls follow.

The water heater 24 is fueled by diesel fuel. Other fuels such as arctic fuel oil, kerosene and gasoline can as well be used, though the diesel fuel is preferred for availability and safety reasons. The fuel source 15 is a diesel fuel tank. It supplies the diesel fuel to the water heater 24 by the fuel source line 17 leading to a connector 28 on the housing 22 and, as best understood with reference to FIG. 3, a fuel connecting line 29 leading therefrom. A fuel pump 30 is interposed in the fuel connecting line 29. The water heater 24 itself is commercially available. It has a BTU capacity of at least about 15,000 BTU's.

Water to be heated by the water heater 24 comes from the external water source 16 to the water heater 24 through the ambient water source line 18. A quick-connect fitting 31 on the water heater unit 10 holds the ambient water source line 18 and is in communication with the water heater 24 through an ambient water inlet line 32 within the housing. A recirculating water pump 33 is disposed in the ambient water inlet line 32 to recirculate water through the water heater as further discussed below. Also interposed in the ambient water inlet line 32 is a strainer 34 and a check valve 35. The strainer 34 filters out particulates. It is optional, though very preferred. The check valve 35 within the ambient water inlet line 32 is responsive to the outflow of water from the water heater unit 10 and effectively controls the flow of ambient water into the water heater 24. It allows additional ambient water to flow into the water heater unit when warmed water flows out. It also prevents hot water from flowing back into the ambient water source line 18.

The ambient water is heated as it flows through the water heater 24 and exits through a primary hot water line 36. This line leads to the hot water holding tank 25 and is permanently connected to it. The holding tank provides a steady supply of substantially constant temperature hot water as needed. It has a capacity of about one gallon to about three gallons. A recirculating water outlet line 37 leads from the holding tank 25 back to the ambient water inlet line 32 and water heater 24. The recirculating water pump 33 runs continuously so that water is always circulating through the water heater and the holding tank. An optional feature, though very preferred for safety reasons is a flow sensing switch 38 positioned in the ambient water inlet line 32. Its purpose is to detect the flow of water through the line and if there is no flow to electrically turn off the water heater. Such flow sensing switches are commercially available.

A secondary hot water line 39 also leads from the holding tank 25. It is connected to the temperature control mixing valve 26 as further discussed below.

The heat exchanger 27 is positioned in the hot water holding tank 25. Its purpose is to transfer heat from the water in the holding tank to water flowing through it. A water inlet line 45 and a water outlet line 46 are connected to the heat exchanger 27 and lead to quick-connect inlet and outlet fittings 47 and 48, respectively on the housing 22. A heat exchanger water pump 49 is interposed in the water outlet line 46 to pull water through the heat exchanger 27. The heat exchanger is best used for supplying a more limited quantity of hot water. For example, and as shown in FIG. 1, the jerry can 11 has a supply hose 50 connected to the quick-connect outlet fitting 48 and a return hose 51 connected to the quick-connect inlet fitting 47 on the portable water heater unit 10. In use, the jerry can 11 is filled with water. The water continuously flows from the jerry can through the heat exchanger, where it is warmed, and flows back into the jerry can. Once the water in the jerry can 11 is heated to a desired temperature, it is drawn out by a spigot or other conventional water valve into coffee cups or other beverage/food containers for immediate consumption.

Figure 3:
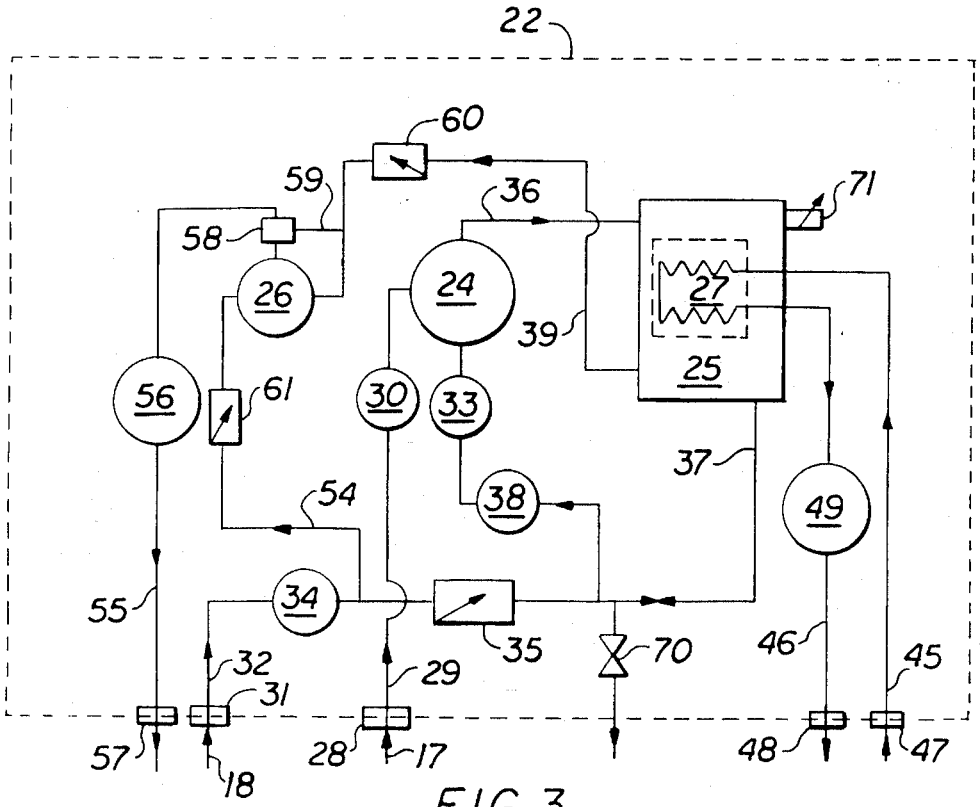
FIG. 3 is a schematic plumbing diagram of the portable water heater unit of FIG. 2.

The temperature control mixing valve 26 is used to mix different sources of water fed to it to provide warm or hot water as desired. For example, warm water only is desired if the shower enclosure system is to be used. Hot water is desired if the food warmer is to be used. The mixing valve 26 is capable of mixing ambient water and hot water supplied to it and delivering either warm or hot water as selected. As shown in FIG. 3, the mixing valve 26 has a secondary ambient water inlet line 54 connected to it and also has the secondary hot water line 39 from the hot water holding tank 25 connected to it. The secondary ambient water inlet line 54 is a by-pass line taken off the ambient water inlet line 32 leading to the water heater 24. It could as well be a separate line leading directly from the external ambient water source 16. The mixing valve 26 is a conventional three-way mixing valve with a single alterable water outlet line 55.

An outflow water pump 56 is preferably interposed in the alterable water outlet line 55 to draw hot water from the secondary hot water line 39 through the mixing valve 20 and also to draw ambient water from the secondary ambient water inlet line 54 through the mixing valve 26. Water which is drawn through the mixing valve 26 is delivered to an outlet connector 57. The outflow water pump 56 as positioned advantageously causes reduced pressures in the hot water holding tank and the water heater. Positioning the outflow water pump to push water through the holding tank and water heater is feasible, but less preferred because of the increased pressures and consequent need for heavier duty components and controls. As should be apparent, any warmed water drawn from the hot water holding tank 25 and flowed through the mixing valve 26 is replenished. That is, the check valve 35 senses when hot water is drawn from the hot water holding tank 25 through the secondary hot water line 39 and opens to allow more ambient water in.

A selector valve 58 is preferably interposed in the alterable water outlet line 55 prior to the intake of the outflow water pump 56 so as to by-pass the temperature control mixing valve 26 when hot water at the outlet is desired. A by-pass water line 59 leads from the secondary hot water line 39 to the selector valve 58. The selector valve is conventional. It can be a manual or electrical valve. Manually selecting a temperature setting at the temperature control mixing valve 26 or, when present, at the selector valve 58 results in either the warm or hot water at the outlet connector 57.

A check valve 60 in the secondary hot water line 39 is used to prevent cold water from the ambient water inlet line 54 from entering. Similarly, another check valve 61 in the ambient water inlet line 54 is used to prevent hot water flowing into it.

As illustrated in FIG. 1, the alterable water outlet line 55 leads to the food warmer 12. As described in U.S. Pat. No. 5,233,969, the food warmer requires hot water for its operation. Accordingly, the temperature control mixing valve 26 is set to the hot setting. The food warmer has a chamber for holding the hot water. Food canisters are suspended in the hot water and, when the food contents are sufficiently warmed, are removed for immediate consumption. Preferably, the chamber of the food warmer is substantially filled with the water and effectively serves as the external water source. An ambient water inlet line leads to the water heater 10 and is connected to the quick-connect fitting 31. A hot water line leads from the water heater's outlet connector 57 to the food warmer. Water is continuously circulated through the food warmer and water heater to ensure that hot water is always present in the chamber of the food warmer.

Figure 4:
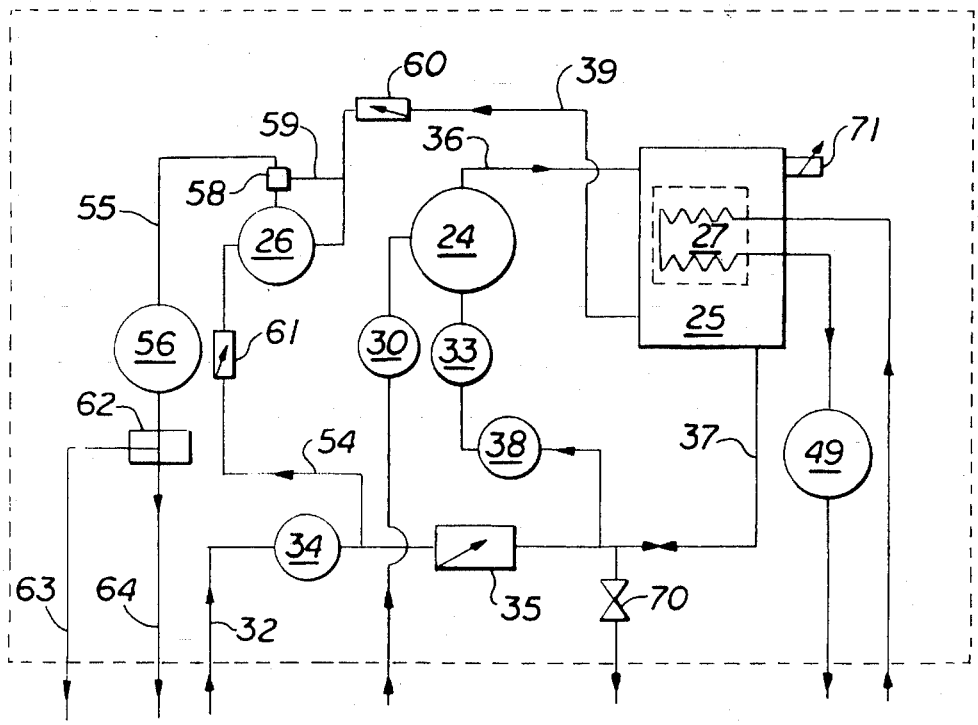
FIG. 4 is another schematic plumbing diagram used in a portable water heater unit of the invention.

Preferably, and as shown in FIG. 4, the alterable water outlet line 55 has a three-way solenoid diverter valve 62 interposed in it after the outflow water pump 56 with a first outlet line 63 to deliver only warm water and a second outlet line 64 to deliver only hot water. The warm water first outlet line 63 with its attendant connector is used as a source of warm water for showering purposes. The hot water second outlet line 64 with its attendant connector is used as a source of hot water for food warming purposes. The three-way selector valve 58 interposed in the alterable water outlet line before the outflow water pump 56 is electrical as well. Both the selector valve 58 and the diverter valve 62 are controlled by a single switch as a safety measure. The valves 58 and 62 can each be manual as well, though is less preferred.

Figure 5:
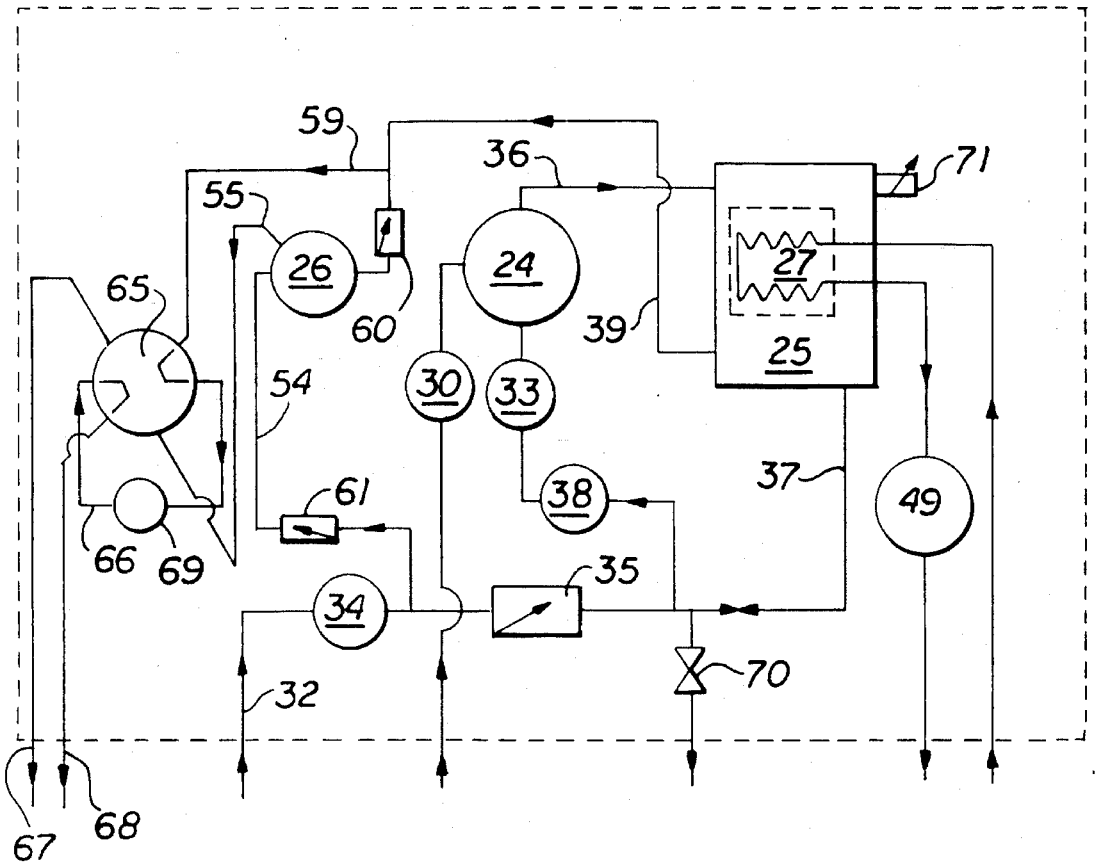
FIG. 5 is still another schematic plumbing diagram used in a very preferred portable water heater unit of the invention.

FIG. 5 illustrates another schematic plumbing diagram of the invention which provides safety features and adds versatility for the user of the portable water heater unit. A six-way mixing valve 65 is utilized in the unit to ensure that warm or hot water is delivered to an outlet without inadvertently delivering the other. As shown, the six-way mixing valve 65 is interposed in the alterable water outlet line 55 leading from the two-way temperature control mixing valve 26. The mixing valve 26 as well as the water lines leading to it and associated components are as above described and are numbered the same.

Six-way mixing valves are known. They have six openings where water delivery or water discharge lines can be connected. There are different water routing configurations within the six-way mixing valve depending on need. The six-way mixing valve 65 used in the water heater unit of FIG. 5 has warm water fed to it by the alterable water outlet line 55 leading from the mixing valve 26. It also has hot water fed to it through the by-pass water line 59 and the secondary hot water line 39. An internal water routing line 66 is connected to the valve 65 to lead from a discharge opening to an intake opening. Depending on the valve's temperature setting, the internal water routing line 66 receives either warm or hot water at the discharge side of the valve and routes it to the intake side of the valve where it is received and further directed within the valve to a warm water outlet line 67 or a hot water outlet line 68. As shown, the six-way valve is set to deliver hot water. The internal water routing line 66 accommodates the outflow water pump 69 interposed therein so as to draw water through it. At the same time, hot water is drawn by the out flow water pump 69 from the secondary hot water line 39 and the hot water holding tank 25.

The six-way mixing valve 65 has two temperature settings. Selecting a warm water setting position causes warm water to flow through the temperature control mixing valve 26 and the alterable water outlet line 55 and into the six-way mixing valve. The warm water is routed within the valve to the internal water routing line 66 and then back into the valve, where it is further routed to the warm water outlet line 67. Similarly, selecting a hot water setting position on the six-way valve 65 causes hot water to flow from the by-pass water line 59 and secondary hot water line 39 into the six-way mixing valve. The hot water is routed within the valve through the internal water routing line 66 and back into the valve where it is further routed to the hot water outlet line 68. Only warm water is available at the warm water outlet line connection and only hot water is available at the hot water outlet line connection. Selecting a water temperature setting effectively selects a water inlet which in turn defines the outlet. This greatly lessens any mistakes in water temperature desired and actually received.

The portable water heater of the invention preferably has built into other features which are not essential to its operation, but provide benefits. For example, with reference to FIG. 3, a drain valve 70 is positioned in the recirculating water outlet line 37 as shown or in another water line within the housing. Its purpose is to provide a means whereby substantially all the water in the unit can be drained. Preferably, for obvious reasons, the unit is dry when it is stored for any length of time or under freezing conditions. A pressure relief valve 71 is also preferably provided for safety reasons. It is a part of a fill cap which is optionally used on the hot water holding tank 25 for water filling purposes when desired. The pressure relief valve is designed to open whenever water pressure within the holding tank exceeds about 15 psi.

Pumps, water line connections and electrical controls used in the portable water heater unit of the invention described above are conventional in nature. They are commercially available and are routinely installed or connected. Various capacity pumps and valve types are selected according to need, intended use and degree of safety desired.

While the portable water heater unit of the invention has been described in detail and particular reference to the drawings, it should be apparent that various modifications and changes can be made. All such modifications or changes of an obvious nature are considered within the scope of the appended claims.

I claim:

1. A portable water heater unit for field use to warm a source of externally supplied ambient temperature water and provide temperature controlled water for multi-use purposes, said water heater unit comprising:

(a) a housing;

(b) a water heater mounted within the housing, said water heater having connected thereto (i) an ambient water inlet line for receiving the ambient temperature water with a recirculating water pump in operable association therewith and (ii) a primary hot water line leading therefrom, wherein the water heater is capable of heating the water which is fed to it;

(c) a hot water holding tank capable of providing upon demand a steady supply of hot water for continuous use, said hot water holding tank mounted within the housing and having connected thereto (i) the primary hot water line leading from the water heater to deliver hot water to said holding tank, (ii) a secondary hot water line leading therefrom and (iii) a recirculating water outlet line leading therefrom to the ambient water inlet line; and (d) a temperature control mixing valve capable of mixing different sources of water fed to said mixing valve to provide warm or hot water, said mixing valve having connected thereto (i) a secondary ambient water inlet line for receiving the ambient temperature water (ii) the secondary hot water line leading from the water tank and (iii) an alterable water outlet line with an outflow water pump operably associated therewith for connection to an external water use article.

2. The portable water heater unit of claim 1 further comprising a heat exchanger capable of providing upon demand a supply of hot water for intermittent use, said heat exchanger positioned in the hot water holding tank and having a water inlet line and a water outlet line with a heat exchanger water pump in operable association therewith such that water which is fed to the heat exchanger by the water inlet line is warmed by the water in the holding tank and is conveyed therefrom through the hot water outlet line for use by an external limited quantity hot water use article.

3. The portable water heater unit of claim 1 further comprising a drain valve in a water line within the housing for draining the water heater unit during non-use periods.

4. The portable water heater unit of claim 1 further comprising a pressure relief valve operably associated with the hot water holding tank.

5. The portable water heater unit of claim 1 further comprising a strainer positioned in the ambient water inlet line to remove debris from water flowing therethrough.

6. The portable water heater unit of claim 1 further comprising a check valve in the ambient water inlet line to allow water to flow to the water heater as water is drawn out of the water heater unit.

7. The portable water heater unit of claim 1 further comprising a six-way valve interposed in the alterable water outlet line leading from the temperature control mixing valve to govern the further flow of the water to separate outlets requiring warm water or hot water to ensure a desired temperature water is received at either of said separate outlets.

8. The portable water heater unit of claim 7 wherein the six-way valve has connected thereto (i) a by-pass water line leading from the secondary hot water line (ii) the alterable water outlet line leading from the temperature control mixing valve, (iii) a warmed water outlet line for use by an external warm water use article, (iv) a hot water outlet line for use by an external hot water use article, and (v) an internal water routing line connected to a discharge side of the six-way valve and connected to an intake side of the six-way valve whereby warm or hot water is pulled from the discharge side of the six-way valve and delivered to the intake side of the six-way valve so as to deliver the warm or hot water to said warmed water outlet line or said hot water outlet line, with the outflow water pump operably positioned in the internal water routing line.

9. The portable water heater unit of claim 1 wherein the water pump in operable association with the ambient water inlet line leading to the water heater is capable of continuously running.

10. A portable water heater unit for field use to warm a source of externally supplied ambient temperature water and provide temperature controlled water through separate outlets for multi-use purposes, said water heater unit comprising:

(a) a housing;

(b) a water heater mounted within the housing, said water heater having connected thereto (i) an ambient water inlet line for receiving the ambient temperature water with a recirculating water pump in operable association therewith and (ii) a primary hot water line leading therefrom, wherein the water heater is capable of heating the water which is fed to it;

(c) a hot water holding tank capable of providing upon demand a steady supply of hot water for continuous use, said hot water holding tank mounted within the housing and having connected thereto (i) the primary hot water line leading from the water heater (ii) a secondary hot water line leading therefrom and (iii) a recirculating water outlet line leading therefrom to the ambient water inlet line;

(d) a temperature control mixing valve capable of mixing different sources of water fed to said mixing valve to provide warm or hot water, said mixing valve having connected thereto (i) a secondary ambient water inlet line for receiving the ambient temperature water (ii) the secondary hot water line leading from the water tank and (iii) an alterable water outlet line with an outflow water pump operably associated therewith for connection to an external water use article; and (e) a six-way valve interposed in the alterable water outlet line leading from the temperature control mixing valve to govern the further flow of the water to separate outlets requiring warm water or hot water whereby selecting a temperature setting on said six-way valve effectively selects an inlet water line to ensure a routing to an outlet line resulting in either warm or hot water as desired.

11. The portable water heater unit of claim 10 wherein the six-way valve has connected thereto (i) a by-pass water line leading from the secondary hot water line (ii) the alterable water outlet line leading from the temperature control mixing valve, (iii) a warmed water outlet line for use by an external warm water use article, (iv) a hot water outlet line for use by an external hot water use article, and (v) an internal water routing line whereby warm or hot water is pulled from a discharge side of the six-way valve and delivered to an intake side of the six-way valve so as to deliver the warm or hot water to said warmed water outlet line or said hot water outlet line, further wherein the outflow water pump operably positioned in the internal water routing line to pull water through the six-way valve and through the water heater unit.

12. The portable water heater unit of claim 10 wherein the recirculating water pump in operable association with the ambient water inlet line leading to the water heater is capable of continuously running.

13. The portable water heater unit of claim 11 further comprising a check valve in the ambient water inlet line responsive to the flow of water from the water heater unit.

14. The portable water heater unit of claim 10 further comprising a heat exchanger capable of providing upon demand a supply of hot water for intermittent use, said heat exchanger positioned in the hot water holding tank and having a water inlet line and a water outlet line with a heat exchanger water pump in operable association therewith such that water which is fed to the heat exchanger by the water inlet line is warmed by the water in the holding tank and is conveyed therefrom through the hot water outlet line for use by an external limited quantity hot water use article.

15. A portable water heater unit for field use to warm a source of externally supplied ambient temperature water and provide temperature controlled water through separate outlets for multi-use purposes, said water heater unit comprising:

(a) a housing;

(b) a water heater mounted within the housing, said water heater having connected thereto (i) an ambient water inlet line for receiving the ambient temperature water with a recirculating water pump in operable association therewith and (ii) a primary hot water line leading therefrom, wherein the water heater is capable of heating the water which is fed to it;

(c) a hot water holding tank capable of providing upon demand a steady supply of hot water for continuous use, said hot water holding tank mounted within the housing and having connected thereto (i) the primary hot water line leading from the water heater to deliver hot water to said holding tank, (ii) a secondary hot water line leading therefrom and (iii) a recirculating water outlet line leading therefrom to the ambient water inlet line;

(d) a temperature control mixing valve capable of mixing different sources of water fed to said mixing valve to provide warm or hot water, said mixing valve having connected thereto (i) a secondary ambient water inlet line for receiving the ambient temperature water (ii) the secondary hot water line leading from the water tank and (iii) an alterable water outlet line with an outflow water pump operably associated therewith for connection to an external water use article; and (e) a heat exchanger capable of providing upon demand a supply of hot water for intermittent use, said heat exchanger positioned in the hot water holding tank and having a water inlet line and a water outlet line with a heat exchanger water pump in operable association therewith such that water which is fed to the heat exchanger by the water inlet line is warmed by the water in the holding tank and is conveyed therefrom through the hot water outlet line for use by an external limited quantity hot water use article.

16. The portable water heater unit of claim 15 further comprising a pressure relief valve operably associated with the hot water holding tank.

17. The portable water heater unit of claim 15 further comprising a check valve in each of the ambient water inlet line, the secondary hot water line, and the secondary ambient water inlet line.

18. The portable water heater unit of claim 15 further comprising a selector valve in the alterable water outlet line prior to the outflow water pump, a by-pass line leading from the secondary hot water line thereto, and a diverter valve in the alterable outlet line after the water pump with a warm water outlet line and a hot water outlet line leading from said diverter valve.

19. The portable water heater unit of claim 18 wherein the selector valve and the diverter valve are electrical and controlled by a single switch.

20. The portable water heater unit of claim 15 wherein the outflow water pump is in the alterable water outlet line to draw water from the hot water holding tank and further wherein the check valve in the ambient water inlet line is responsive to water drawn by the outflow water pump and through the outlets so to allow more ambient water into the water heater unit.

* * * * *